United States Patent [19]

Jones

[11] 4,319,635

[45] Mar. 16, 1982

[54] METHOD FOR ENHANCED OIL RECOVERY BY GEOPRESSURED WATERFLOOD

[75] Inventor: Paul H. Jones, Baton Rouge, La.

[73] Assignee: P. H. Jones Hydrogeology, Inc., Baton Rouge, La.

[21] Appl. No.: 125,919

[22] Filed: Feb. 29, 1980

[51] Int. Cl.[3] ..... E21B 33/124; E21B 43/18; E21B 43/24; E21B 43/40

[52] U.S. Cl. ..... 166/263; 166/52; 166/57; 166/75 R; 166/127; 166/227; 166/266; 166/267; 166/303; 166/306

[58] Field of Search ..... 166/263, 266, 267, 268, 166/272, 303, 305 R, 306, 314, 127, 191, 227

[56] References Cited

U.S. PATENT DOCUMENTS

| | | | |
|---|---|---|---|
| 1,861,332 | 5/1932 | Waitz | 166/305 R |
| 2,104,327 | 1/1938 | Kotzebue | 166/306 X |
| 2,156,709 | 5/1939 | Taylor | 166/127 X |
| 2,633,200 | 3/1953 | Humason | 166/127 |
| 2,736,381 | 2/1956 | Allen . | |
| 2,969,226 | 1/1961 | Huntington | 166/272 X |
| 3,022,827 | 2/1962 | Getzen | 166/305 R X |
| 3,126,961 | 3/1964 | Craig, Jr. et al. | 166/306 X |
| 3,258,069 | 6/1966 | Hottman . | |
| 3,349,849 | 10/1967 | Closmann | 166/303 X |
| 3,354,952 | 11/1967 | Engle | 166/306 X |
| 3,455,392 | 7/1969 | Prats | 166/303 |
| 3,679,264 | 7/1972 | Huisen | 166/303 X |
| 3,887,008 | 6/1975 | Canfield | 166/267 |
| 3,934,650 | 1/1976 | LaFortune | 166/267 |
| 4,066,127 | 1/1978 | Harnsberger | 166/306 X |
| 4,078,608 | 3/1978 | Allen et al. | 166/272 X |
| 4,149,596 | 4/1979 | Richardson et al. | 166/314 X |
| 4,199,028 | 4/1980 | Caughey | 166/272 X |

*Primary Examiner*—Stephen J. Novosad
*Assistant Examiner*—George A. Suchfield
*Attorney, Agent, or Firm*—Fleit & Jacobson

[57] ABSTRACT

The recovery of petroleum produced from an oil reservoir is enhanced by injecting water such as from a geopressured aquifer having a natural gas content at or near saturation at a temperature above 300° F. into the oil reservoir at a flow rate sufficient to develop a back-pressure in the oil reservoir equal to between about 80% of its fracture pressure and a pressure below its fracture pressure and producing oil from the oil reservoir when the injection of water necessary to maintain the back-pressure below the oil reservoir fracture pressure drops below a predetermined level. The recovery of petroleum also is enhanced by using sand screening means to complete a portion of the well bore penetrating into the oil reservoir and a straddle packer assembly means which can be raised and lowered relative to the screening means.

28 Claims, 12 Drawing Figures

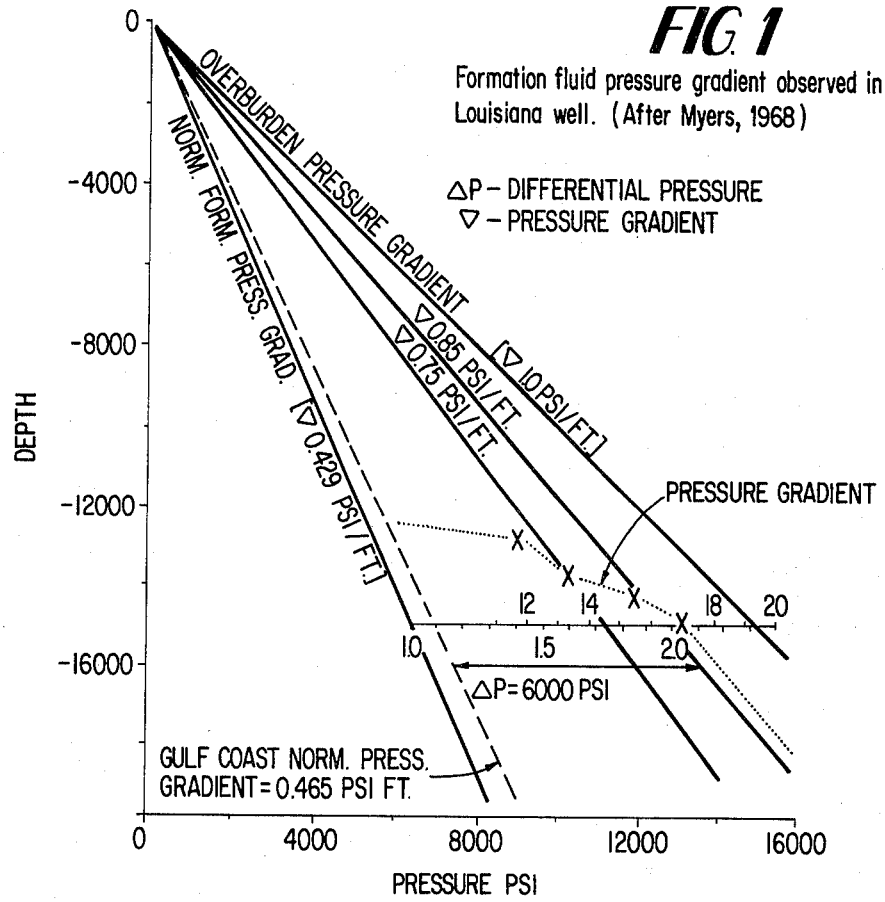
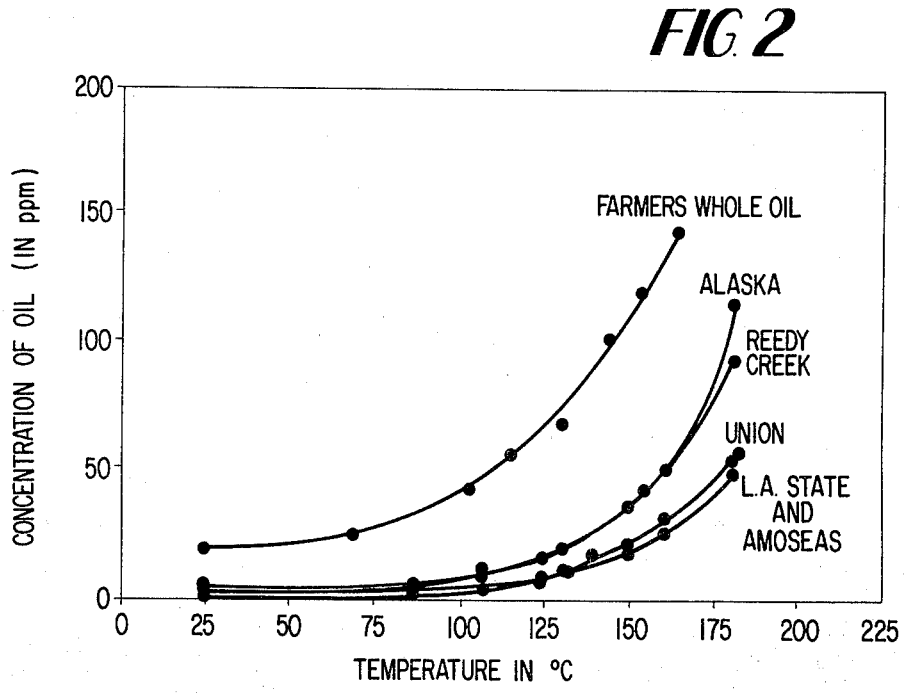
Solubilities of two whole oils and four topped oils in water as a function of temperature, in the range 25° to 180° C, at the pressures developed in the test containers. (From Price, 1976.)

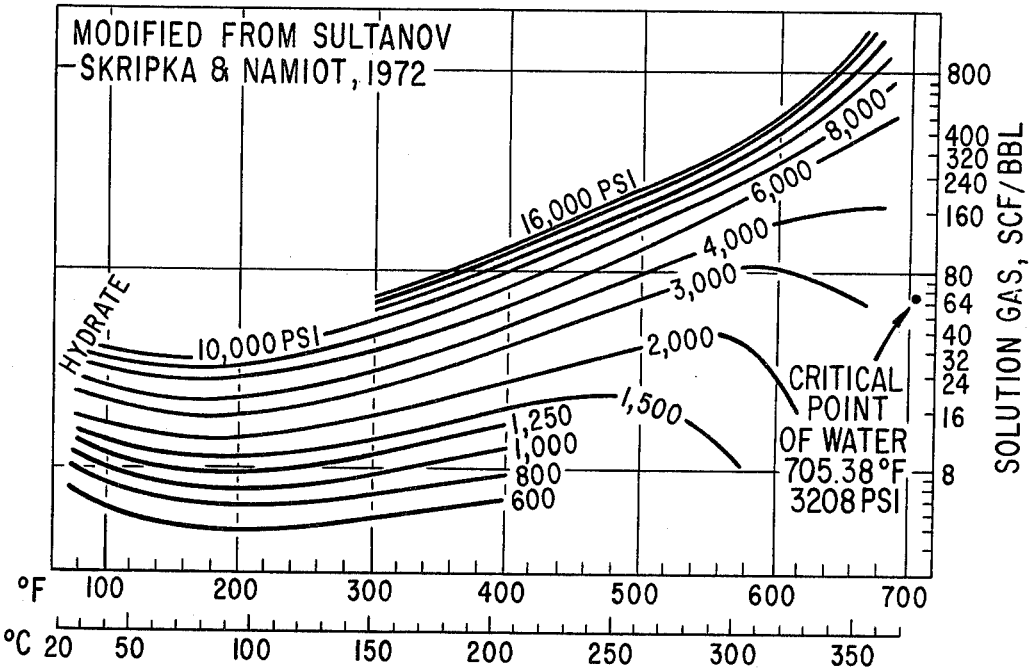
FIG. 3 Solubility of methane in fresh water in the temperature range 30° to 360° C (86° to 680° F) at pressures of 600 to 16,000 psi. (After Sultanov et al, 1972)
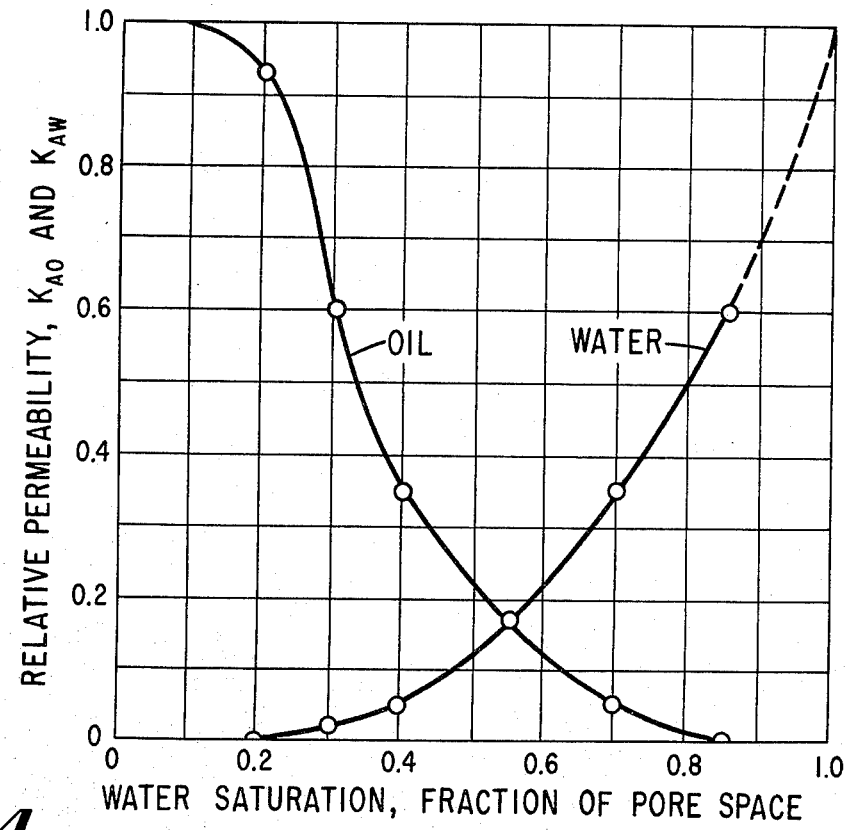
FIG. 4 Water-oil relative permeability curves. (From Craft and Hawkins, 1959)

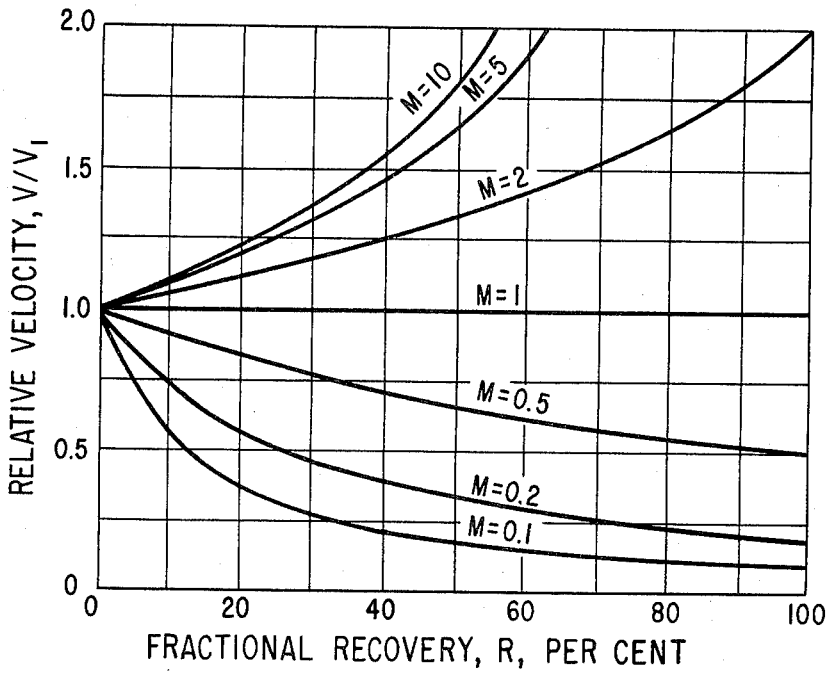
FIG. 5 Relative velocity of the flood front in a single, linear bed as a function of mobility ratio. (From Craft and Hawkins, 1959)
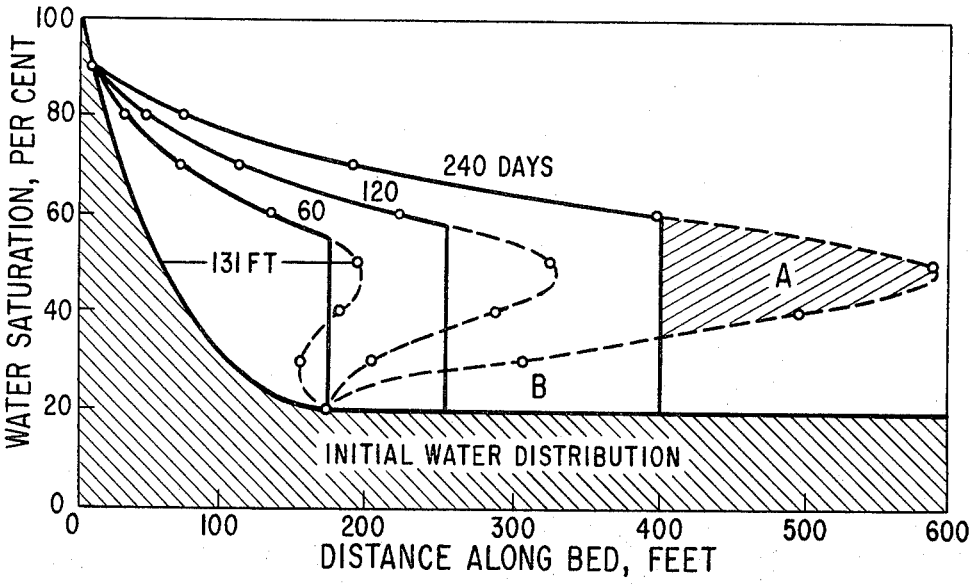
FIG. 6 Fluid distributions at initial conditions at 60, 120 and 240 days. (From Craft and Hawkins, 1959, Fig. 7.7.)

Flood-front profiles of injected water at successive equal time intervals after initiation of injection, for a reservoir having the indicated water saturation gradient with depth.

FIG. 9

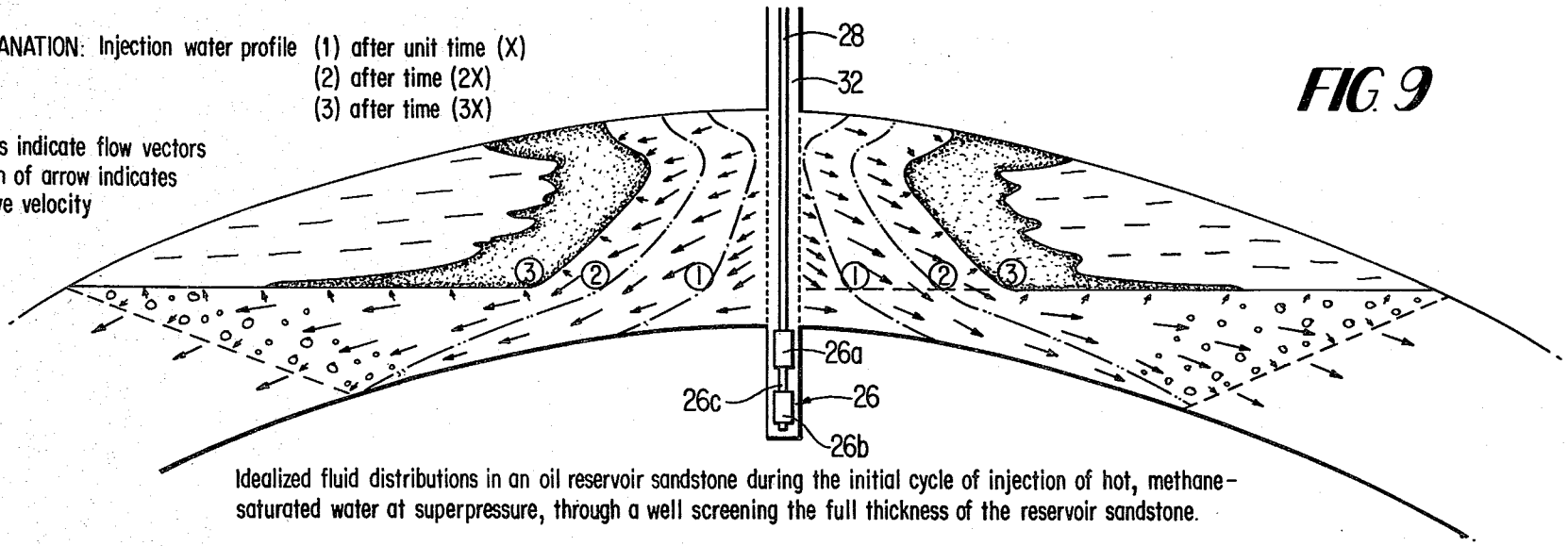

Idealized fluid distributions in an oil reservoir sandstone during the initial cycle of injection of hot, methane-saturated water at superpressure, through a well screening the full thickness of the reservoir sandstone.

FIG. 10

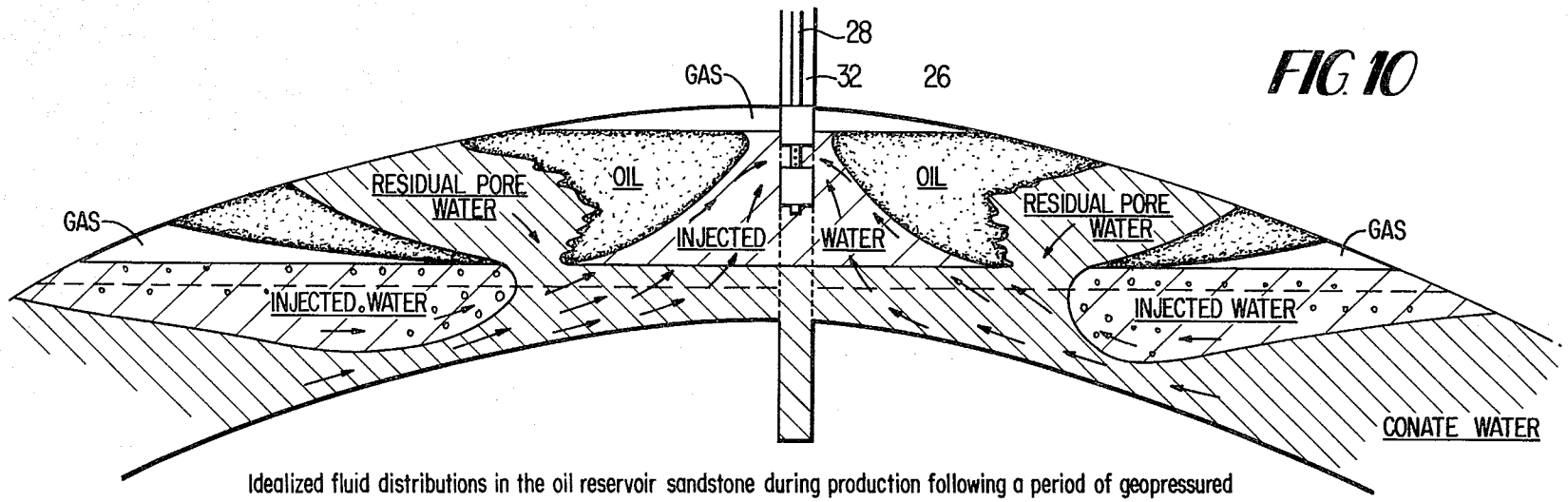

Idealized fluid distributions in the oil reservoir sandstone during production following a period of geopressured waterflood using hot, methane saturated water from a geopressured aquifer.

Idealized fluid distributions in the oil reservoir sandstone during a second, third, or fourth injection cycle in the geopressured waterflood operation.

Idealized fluid distributions in the oil reservoir sandstone during the optimal production cycles of the geopressured waterflood operation.

METHOD FOR ENHANCED OIL RECOVERY BY GEOPRESSURED WATERFLOOD

BACKGROUND OF THE INVENTION

1. Field of the Invention

This invention relates to a method and apparatus for the enhanced recovery of petroleum. Its application could increase the recoverability of oil originally in place from the 30 to 40 percent now common, using current technology, to as much as 80 percent or more. Immediate use of this invention in newly discovered reservoirs, as well as in those now producing, could greatly accelerate the rate of oil production in the United States; also, it could bring back into production many "depleted" oil reservoirs that have been produced to abandonment using current technology.

2. Description of the Prior Art

Hydropressured aquifers are porous, permeable water-bearing formations in which the interstitial fluid pressure reflects the weight of the superincumbent water column, unconfined above, and open to the atmosphere. The depth-pressure gradient is mainly a function of the dissolved solids content of the formation water, and may range from about 0.3 to about 0.5 pound per square inch per foot of depth.

Geopressured aquifers are not open to the atmosphere, having been compartmentalized by faulting, and their fluid pressure reflect a part of, or all of, the weight of the superincumbent rock deposits. The depth-pressure gradient is mainly a function of rate of leakage, or fluid escape, from the aquifer system, and may range from about 0.5 to about 1.0 pound per square inch per foot of depth.

Geopressured aquifers exist along the Gulf Coast of the United States and in many other places throughout the world where sedimentary deposits have been rapidly buried. Due to the high pressures found in geopressured aquifers, if a well is drilled into the aquifer, water will flow to the surface of the ground in artesian fashion.

Natural gas may be present in geopressured aquifers in any of these forms:

(1) gas dissolved in the water;

(2) free gas dispersed in water within the rock pores; and (3) a free gas phase present within the rock pores and separate from the water.

The natural gas contained in aquifers is commonly 95–98% or more methane.

Publications which relate to the background of this invention and which are referred to herein are as follows:

1. Craft and Hawkins, "Applied Petroleum Reservoir Engineering," Prentiss-Hall, Inc., Englewood Cliffs, N.J., 1959.
2. Doscher, "Tertiary Recovery of Crude Oil," in The Future Supply of Nature-Made Petroleum and Gas, Pp. 455–480: Proceedings of the First UNITAR Conference on Energy and the Future, 5–16, July, 1976, R. F. Meyer, Ed. Pergamon Press, New York, 1977.
3. Jones, "The Role of Geopressure in the Fluid Hydrocarbon Regime," in Exploration and Economics of the Petroleum Industry, V. 16, Pp. 211–227, Matthew Bender & Company, New York, N.Y., 1978.
4. Hocott, "Enhanced Oil Recovery: What of the Future?" in the Future Supply of Nature-Made Petroleum and Gas, Pp. 389–396: Proceedings of the First UNITAR Conference on Energy and the Future, 5–16 July, 1976, R. F. Meyer, Ed. Pergamon Press, New York, 1977.
5. Caudle, "Secondary Recovery of Oil," in The Future Supply of Nature-Made Petroleum and Gas, Pp. 397–410: Proceedings of the First UNITAR Conference on Energy and the Future, 5–16 July, 1976, R. F. Meyer, Ed. Pergamon Press, New York, 1977.
6. Myers, "Differential Pressures, A Trapping Mechanism in Gulf Coast Oil and Gas Fields," Gulf Coast Association of Geological Societies, V. 18, Pp. 56–80, 1968.
7. Price, "Aqueous Solubility of Petroleum as Applied to its Origin and Primary Migration," American Association of Petroleum Geologists Bull., V. 60, No. 2, Pp. 213–244, 1976.
8. Price, "The Solubility of Hydrocarbons and Petroleum in Water as Applied to the Primary Migration of Petroleum," Ph. D. Dissertation, Univ. of California, Riverside, 298 p., 1973.
9. Bray and Foster, "Process for Primary Migration of Petroleum in Sedimentary Basins (abs.)," American Association of Petroleum Geologists Bull., V. 63, No. 4, Pp. 697–698, 1979.
10. Sultanov et al, "Solubility of Methane in Water at High Temperatures and Pressures," Gazovaia promphlennost, V. 17, No. 5, Pp. 6–7, 1972.
11. Price, "Aqueous Solubility of Methane at Elevated Pressures and Temperatures," American Association of Petroleum Geologists Bull., V. 63, No. 9, Pp. 1527–1533, 1979.
12. Fertl and Timko, "How Downhole Temperatures, Pressures, Affect Drilling," World Oil, Feb. 1, Pp. 47–50, 1973.
13. Buckley and Leverett, "Mechanism of Fluid Displacement in Sands," Petroleum Transactions, American Institute of Mining and Metallurgical Engineers, V. 146, p. 107, 1942.
14. MacElvain, "Mechanics of Gaseous Ascension Through a Sedimentary Column," in Unconventional Methods in Exploration for Petroleum and Natural Gas Pp. 15–28, Institute for the Study of Earth and Man, Southern Methodist Univ., Dallas, Tex., 1969.
15. Farr, "How Seismic is Used to Monitor EOR Projects," World Oil, V. 189, No. 7, December 1979.
16. Ritch and Smith, "Evidence for Low Free Gas Saturations in Water-Bearing Bright Spot Sands," Pp. 1–11: Proceedings of Seventeenth Annual Logging Symposium SPWLA, 1976.

The maximum efficient rate at which oil can be recovered from a reservoir, and the recoverable percentage of the original oil-in-place may, or may not, be dependent upon the rate at which the reservoir is produced. Recovery from true solution gas-drive reservoirs by primary depletion is essentially independent of both individual well rates and total reservoir production rates. Recovery from very permeable, uniform reservoirs under very active water drives may also be essentially independent of the rates at which they are produced (Craft and Hawkins, 1959, p. 197).

When oil is displaced immiscibly from a porous rock, such as by gas or water, a residual oil saturation is reached beyond which no more oil flows out of the individual pores. At this stage, the oil is no longer in continuous phase, having been coalesced by capillary forces into isolated, discrete droplets which cannot be displaced by the viscous forces available in the reservoir. It is this break-up of the continuous filaments of the oil phase that enhanced oil recovery processes seek to reverse or to prevent, if inaugurated soon enough (Hocott, 1977, p. 390).

Several methods for the enhanced recovery of petroleum from watered-out, pressure-depleted oil reservoirs are now in use, but none has yet proved commercial from an economic standpoint, except for certain terminal installations (Hocott, 1977, p. 394). Enhanced recovery, sometimes called tertiary recovery, may not be feasible where reservoir damage has occurred during primary or secondary oil recovery operations, or where the remaining residual oil saturation is too low. The operator who wishes to improve appreciably the ultimate recovery of oil from a producing reservoir should initiate enhanced recovery operations as soon as possible. Methods of enhanced recovery of petroleum that can begin during conventional waterflood operations are of special importance. Nearly half of the oil now produced in the United States comes from waterflood projects (Caudle, 1977, p. 397).

Enhanced oil recovery methods now in use flush the reservoir with polymers, carbon dioxide, surfactants, and solubilizers, using the following guidelines: (1) interfacial tension is increased, if possible, to enhance the effectiveness of waterflooding; (2) where oil saturation is high and connate water saturation is low, enhanced recovery by water drive is favored; and (3) where connate water saturation is high, recovery by gas drive is favored. Other methods create and drive a fireflood through the "depleted" oil reservoir using air-injection wells in which heated and mobilized residual oil moves to production wells for recovery, or they flood the "depleted" oil reservoir with steam, heating and mobilizing the oil, and driving it to recovery wells. In California, more than 10 percent of the production of oil is now by steam flood.

All of these enhanced oil recovery methods are costly and complicated. Those requiring expensive chemical additives usually fail or are marginally successful, because heterogeneity of texture and permeability in reservoir rocks makes prediction of flow path at project scale difficult or impossible.

New knowledge regarding the migration and accumulation of petroleum in deep sedimentary basins which is applied in the enhanced recovery of oil in accordance with the invention include:

1. Petroleum crude is highly soluble in water of low salinity (less than 50,000 mg/l) at elevated temperatures. Solubility increase is gradual to about 100° C. (212° F.) and rapid at higher temperatures because of a change in the solution mechanism (Price, 1976, p. 237) (see FIG. 2).
2. The aqueous solubility of the least soluble compounds of petroleum increase most rapidly with rising temperature, above 100° C. (212° F.) (Price, 1973).
3. The aqueous solubility of petroleum crude in low salinity water is greatly increased at elevated pressure and temperature by saturating the water with carbon dioxide and hydrocarbon gases (mainly methane) (Bray and Foster, 1979).
4. The aqueous solubility of natural gas (methane) increases rapidly with pressure and temperature above 4,000 psi and 150° C. (Sultanov et al, 1972) and exceeds 100 standard cubic feet per barrel of water (scf/bbl) at 9,000 psi and 221° C.; exceeds 200 scf/bbl at 10,000 psi and 280° C.; 300 scf/bbl at 27,000 psi and 280° C.; 400 scf/bbl at 12,000 psi and 316° C.; and 500 scf/bbl at 23,000 psi and 316° C. The maximum solubility measured by Price (1979) was 828 scf/bbl at 28,610 psi and 354° C. (see FIG. 3).
5. Formation waters of the geopressure zone, in geologically young petroliferous basins (of Mesozoic or Cenozoic age), are universally saturated in methane, and have temperatures generally above 100° C.
6. Almost all (99 percent) of the oil produced in the northern Gulf of Mexico basin was recovered from reservoirs having initial temperatures less than 150° C. (302° F.) (Fertl and Timko, 1973).
7. More than 90 percent of the oil that has been produced in the northern Gulf of Mexico basin was recovered from reservoirs having initial fluid pressures reflecting pressure gradients less than 0.7 psi/ft.
8. The method and apparatus of this invention also depend heavily upon the principles of oil displacement defined by the relative permeability concept (Buckley and Leverett, 1942) (see FIG. 4).

Although many methods and types of apparatus for enhanced recovery of oil have been patented, none describe the method and apparatus of this invention. The method of U.S. Pat. No. 2,736,381 to J. C. Allen granted Feb. 28, 1956, and assigned to The Texas Company, involves a downhole cross-connection of a high-pressure dry gas reservoir with a lower pressured condensate reservoir, resulting in increased production from other wells completed in the condensate reservoir. No mention of water is made in that patent.

U.S. Pat. No. 3,258,069 to C. E. Hottman granted June 28, 1966, and assigned to Shell Oil Company, discloses completing a well into an overpressured water-bearing reservoir and transporting superheated water from the reservoir into the injection tubing string of an oil-bearing reservoir, evaporating some of the water in the injection tubing string, and producing oil displaced by the injection of water and steam from an adjacent production well.

SUMMARY OF THE INVENTION

The mechanism of this invention replicates (Jones, 1978) that by which petroleum migrates and accumulates naturally in the geopressured petroliferous sedimentary basins of the world which contain about half of the world's known commercial reserves. Water having a dissolved natural gas content at or near saturation at a temperature above 300° F. is injected at high pressure, preferably only slightly below reservoir fracture pressure, into oil reservoir rocks through wells that are preferably open through the full thickness of the reservoir, for example, by a well screened through the full thickness of the reservoir.

The interstitial fluid pressure in the reservoir raised by the injection to a pressure approaching the fracture pressure causes an appreciable increase in reservoir porosity and permeability (Hocott, 1977, p. 395), reduces the size of dispersed gas bubbles that may be present, and increases gas solubility. It greatly increases the hydrodynamic (fluid driving) force—the gradient in head—that can be applied, to move the oil during production.

The temperature of interstitial fluids and the rock matrix of the reservoir is raised 100° to 150° F. or more, greatly reducing fluid viscosity, appreciably reducing fluid density, increasing buoyancy forces and enhancing the aqueous solubility of oil and gas. Mobilization and displacement of oil following pressurization of the reservoir, and production through one or more wells of specialized design, are preferably accomplished by a series of injection-production cycles in which stratified (or layered) flow is induced by controlling the depth at which fluids (oil, gas, water) are injected into, or produced from, the reservoir rock.

Source water for pressured waterflood may be "tailor made" (e.g., heated, pressurized, and saturated with natural gas) using suitable make-up water and aboveground equipment, or it may be obtained from an aquifer in a nearby or underlying geopressure zone. The source water passes through thermally insulated, high pressure well-head equipment designed to control the flow rate, chemistry, dissolved gas content, temperature, and pressure of water that is injected into the oil reservoir.

Cross-connecting a geopressured aquifer with an oil reservoir in a sandstone trap, for example, supplies source water that is nature made and pressurization of the oil reservoir rock is accomplished without pumping. A source aquifer is selected having a temperature preferably above 300° F. Water in the geopressured aquifer is saturated or near saturated with natural gas, principally methane. If the pressure of the geopressured aquifer exceeds the fracture pressure of the oil reservoir to be flooded, water from the source well may be directed through a gas separator to accomplish the desired pressure drop.

Gas stripped from the aquifer water can be used to fuel boilers designed to raise the temperature of the same aquifer water prior to injection, to improve its "sweep" characteristics. Methane naturally occurring in the aquifer water dissolves in pressurized reservoir oil, reducing its density and viscosity. As a result, buoyancy and hydrodynamic forces are increased, and very large pressure gradients towards production wells are created. Any residual oil is dissolved in the high-temperature waterflood and most, if not all, of the oil in the reservoir is mobilized and recovered.

Subsequently, the sensible heat remaining in the injected water is recovered by flowing the injected water back to the surface. Finally, any remaining vapor-phase gas which is released from water solution with falling pressure and temperature as water production occurs is produced from the oil-depleted trap. In this manner, most, if not all, of the dissolved natural gas in the injected water, and perhaps half of the low-grade heat in the injected water can be recovered from the oil reservoir after enhanced oil recovery operations are completed. Also, the geopressured aquifer can be produced for heat and/or the natural gas whenever its flow is not required for waterflood, if a cyclic injection-production methodology is used for enhanced oil recovery.

Two or more wells screened in shallow salt water aquifers provide for disposal or storage of water produced from the geopressured aquifer in excess of injection requirements for enhanced oil recovery. Well-head facilities enable separation and storage of produced fluids; superheating of injection water; continuous monitoring of reservoir pressure; automated flow and pressure control; injection water quality control; and selective, repeated settings of an inflatable, retrievable straddle packer on a production line within or below the screened oil reservoir.

In oil reservoirs there is a vertical transition zone between the level at which the rock is 100 percent water saturated, and the level at which critical oil saturation occurs. In this transition zone, both the water and the oil are essentially immobile. FIG. 5 (Craft and Hawkins, 1959, FIG. 7.7) shows the relative velocity of a flood front in a horizontal sandstone reservoir under a constant pressure gradient, and the fractional recovery of recoverable oil for different mobility ratios. On this figure, M is the mobility ratio, R is the fractional recovery of recoverable oil, V is the apparent velocity in barrels per day per square foot, and Vi is the initial velocity (Craft and Hawkins, 1959, FIG. 7.24). FIG. 6 is a profile of fluid distributions in such a reservoir after indicated periods of flow, as a consequence of the vertical gradient in water saturation.

The thickness of the transition zone gradually increases as a commercial reservoir is produced to depletion and watered out. In depleted reservoirs, the very low relative permeability of the thickened transition zone, which may in fact comprise essentially the full initial thickness of the depleted oil reservoir, is critically important to the method of this invention. Its effect upon radial flow from an injection well screened through the full thickness of a reservoir sandstone is illustrated in FIG. 7. Successive flood-front profiles at equal time intervals after injection was begun reflect the vertical gradient in relative permeability.

Use of the method and apparatus of this invention causes profound changes in oil and reservoir-rock characteristics, enabling drastic increase in the rate at which individual wells, and total reservoirs, may be produced, while raising the percent recoverability of the original oil-in-place. Any oil reservoir—newly discovered, producing, or depleted by conventional technology—can be converted to solution gas-drive and very active water drive with simultaneous increase in reservoir porosity and permeability, using this invention.

Less than 30 percent of the original oil-in-place is generally recovered by conventional primary production technology, and less than 50 percent by a combination of primary and secondary recovery methods, including waterflood and injection gas-drive. Of the 440 billion barrels of oil discovered in the United States by 1980, perhaps 145 billion barrels (33 percent) will be recovered by conventional technology (Doscher, 1977, p. 456). Enhanced oil recovery by the method and apparatus of this invention is especially appropriate for use in the California and Gulf of Mexico basins where some 90 billion barrels of oil, unrecoverable by conventional production technology, occur in reservoirs overlying potentially usable geopressured "source" aquifers.

Use of the method and apparatus of this invention improves the hydraulic properties of the reservoir (increased porosity and permeability); decreases the interfacial tension between oil, gas, and water (increasing the aqueous solubility of oil and gas); reduces the viscosity (resistance to flow) of both the oil and reservoir water; increases the buoyancy gradient of the oil; and increases the gradient in head (the hydrodynamic force) available to move the oil. The method avoids the cost of surfactants, solubilizers, polymers, and all chemical additives—except those required to prevent formation of precipitates in the waterflood. The method using a geopressured source well avoids the cost of high-capacity pumps capable of operating under very high pressures, and the energy to drive them, for water injection.

BRIEF DESCRIPTION OF THE DRAWINGS

FIG. 1 is a graph of the formation fluid pressure gradient observed in an offshore Louisiana well;

FIG. 2 is a graph of the solubilities of two whole oils and four topped oils in water as a function of temperature, in the range 25° C. to 180° C., at the pressures developed in the test containers;

FIG. 3 is a graph of the solubility of methane in fresh water at selected temperatures and pressures;

FIG. 4 is a graph of the water-oil relative permeability curves;

FIG. 5 is a graph of the relative velocity of the flood front in a single, linear bed as a function of mobility ratio;

FIG. 6 is a graph of the fluid distributions at initial conditions and at selected time intervals;

FIG. 9 represents the idealized fluid distributions in an oil reservoir sandstone during the initial cycle of injection of hot, methane-saturated water at superpressure, through a well screening the full thickness of the reservoir sandstone in accordance with the present invention.

FIG. 10 represents the idealized fluid distributions in the oil reservoir sandstone during production following a period of geopressured water flood using hot, methane-saturated water from a geopressured aquifer in accordance with the present invention;

DESCRIPTION OF THE PREFERRED EMBODIMENTS

Figure 7:
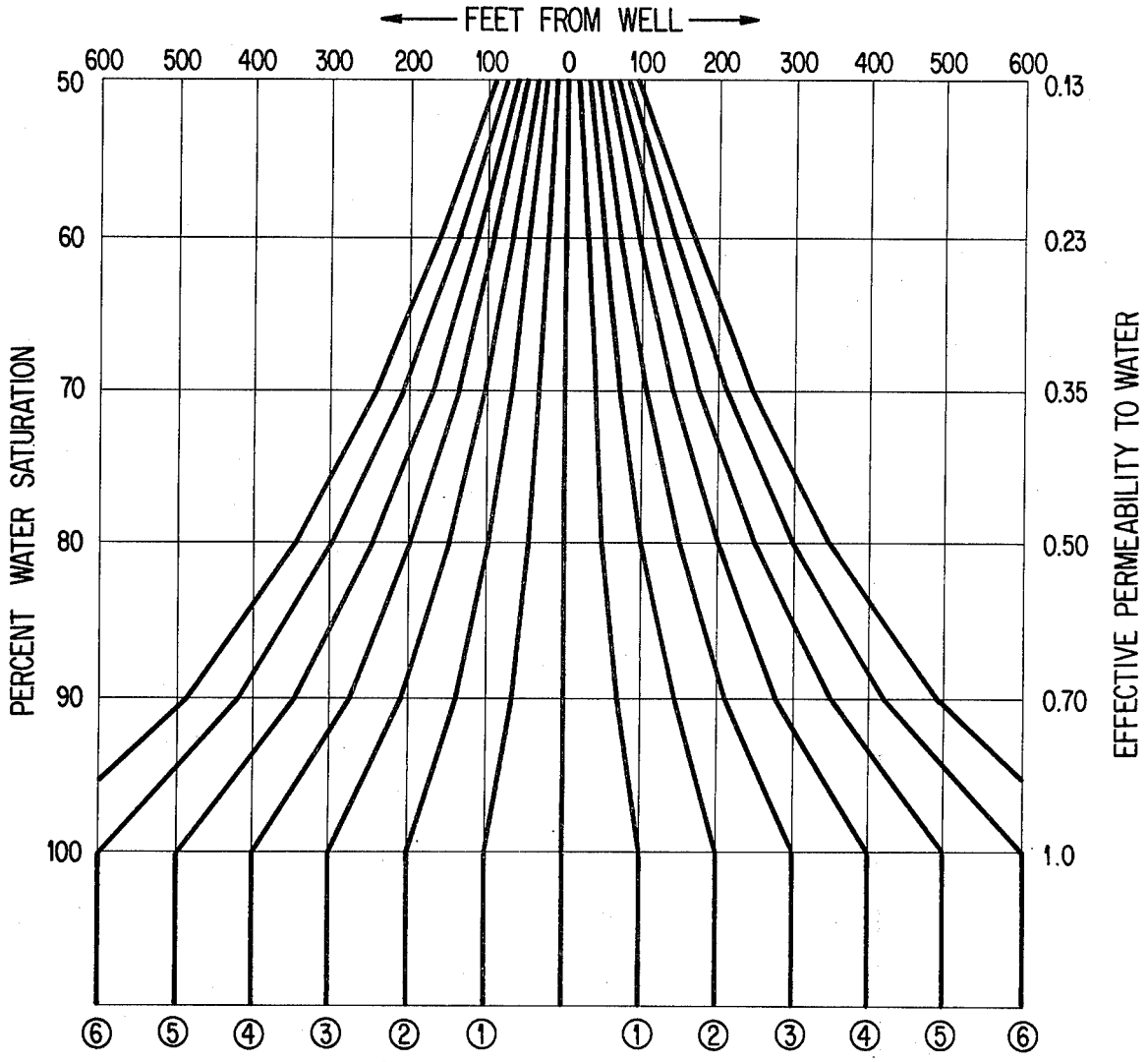
FIG. 7 is a graph of the flood front profiles of injected water at successive equal time intervals after initiation of injection, for a reservoir having the indicated water saturation gradient depth.
Figure 8:
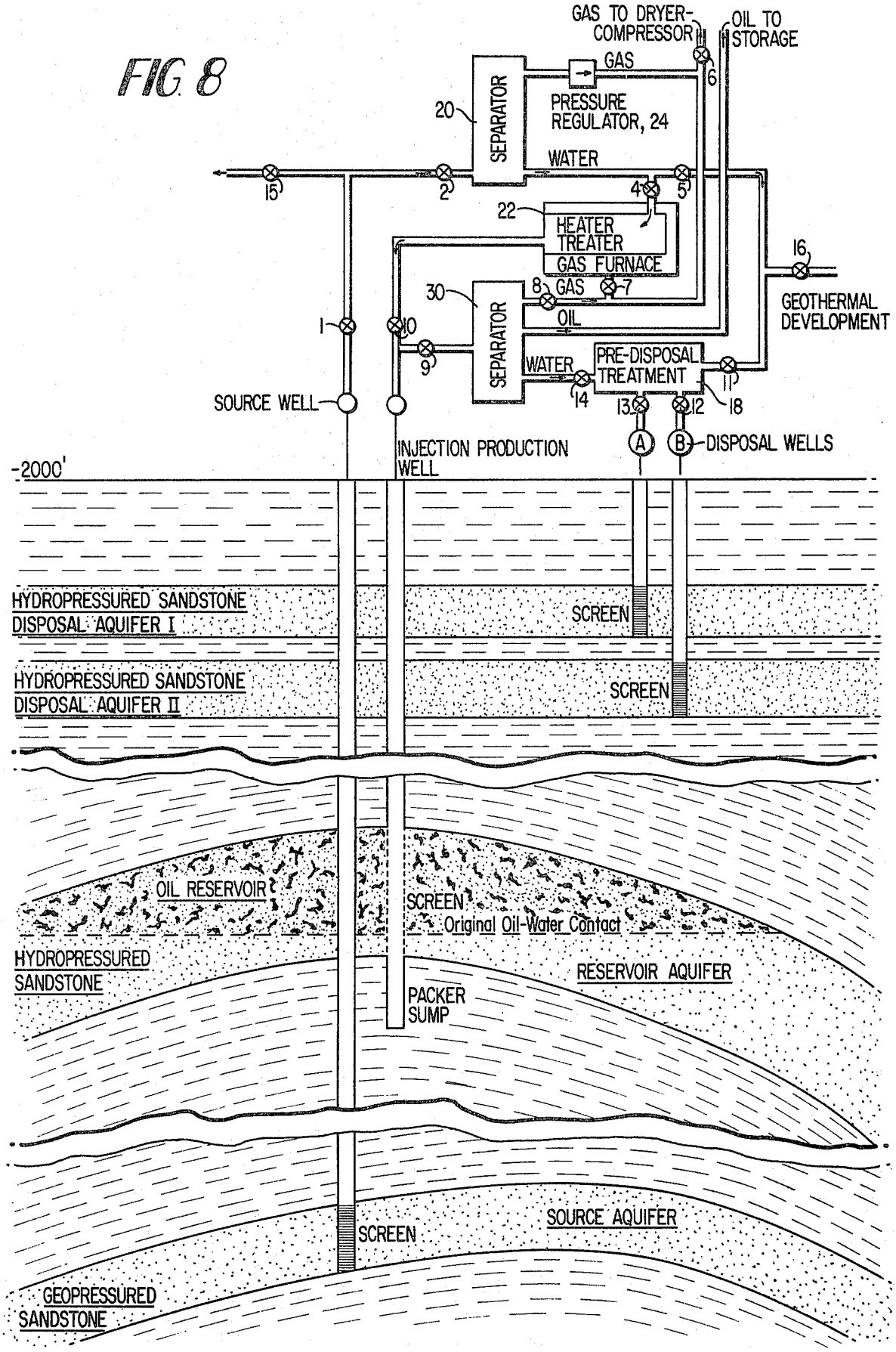
FIG. 8 is a schematic illustration of the method and apparatus of the present invention and, more particularly, is a sketch profile showing a subsurface configuration and relative depth of the oil reservoir, source aquifer, and disposal aquifers cross-connected by wells, and a schematic view of the above-ground apparatus of the invention.

Referring to FIG. 8, a source well is drilled into a geopressured source aquifer containing water having a temperature preferably above 300° F. and having large quantities of natural gas dissolved or dispersed therein at saturation or near saturation levels. The source aquifer should have a closed-in well-head pressure which exceeds the fracture pressure of the oil reservoir to be flooded. The well may be constructed with a conventional liner and casing up to the point at which the bore enters the aquifer. The portion of the well bore penetrating into the aquifer is completed with a screen instead of a perforated liner.

The screen is of the type conventional for water wells in sand aquifers, but is usually not employed in oil or gas wells, except when serious sanding problems exist. Such a screen typically comprises a wire-wrapped perforated pipe in which 40 to 60 percent of the surface area is removed by equally spaced drill holes, generally $\frac{1}{4}$ to $\frac{3}{4}$ inch in diameter. The pipe is fitted with evenly spaced longitudinal stringers on the outside. The body of the pipe is wrapped with a winding of trapezoidally cross sectioned wire, placed so that the base of the trapezoid is on the outside, and spaced apart so that the slot formed between the windings is sufficient to pass only the 70% fines of the sand. This screen acts to permit the gas-water liquid and the gas of the aquifer to enter into the well, without admitting sufficient sand particles to clog the well.

An injection-production well is drilled into an oil reservoir. The well may be constructed with a conventional liner and casing up to the point at which the bore enters the oil reservoir. The portion of the well bore penetrating into the oil reservoir and any adjacent reservoir aquifer is completed with a screen of similar type to that employed in connection with the source well. A conventional straddle packer assembly illustrated in FIGS. 9–12 is installed in the injection-production well and initially positioned in a packer sump at the bottom of the well. The straddle packer assembly is mounted on production tubing (e.g. 4 to 6 inches in diameter). An annulus is defined between the production tubing and the wire-wrapped perforated pipe (e.g., 8 to 10 inches) which comprises the screen, as well as between the production tubing and the casing. The production tubing passes through a conventional packing gland at the injection-production well-head and is supported by any suitable hanger-elevator system capable of setting the straddle packing assembly at any desired depth in the screened oil reservoir or adjacent reservoir aquifer, with closed-in pressures up to 3,000 psi. A valve (not shown) is associated with the annulus at the well-head to open or close the annulus.

Two disposal wells ("A" and "B") are drilled into hydropressured disposal aquifers (hydropressured sandstone disposal aquifers "I" and "II") at appropriate distances from the source well and the production-injection well. The disposal wells are designed to tap suitable salt water aquifers at the shallowest depths permitted for disposal. The capacity of each disposal well is sufficient to receive the maximum flow rate of the source well without back-pressure buildup exceeding the fracture pressure of the disposal-well aquifer. The disposal wells may be constructed with a conventional liner and casing up to the points at which the bores enter the aquifers. The portions of the well bores penetrating into the aquifers are completed with a screen of similar type used in connection with the source well. The second disposal well ("B") is simply a standby well for disposal or storage.

Flow from the source well is begun at a rate increasing, for example, from about 100 gallons per minute (gpm) to about 1,000 gpm, with discharge through a conventional pre-disposal treatment plant 18 to disposal well "A". The predisposal treatment plant is used, if necessary, to ensure that the source water is compatible with the water and rock in the disposal aquifer. Valves numbered 1, 2, 3, 5, 6, 11 and 13 are open and all others are closed. Pressure is dropped approximately to that of the oil reservoir, typically about 250 psi at the well head, with attendant gas exsolution, gas separation in conventional separator 20, and recovery. When flow has stabilized, valves 4, 7 and 10 are gradually opened and valves 5 and 6 are gradually closed. The gas-fired water heater 22 is put into operation, heating the gas-depleted source water to the maximum temperature possible with system gas, typically 400° to 500° F., before it is directed to the injection-production well. The source water is injected into the full thickness of the reservoir via the annulus and screen.

Flow into the injection-production well is increased, for example, to from about 100 to about 1,000 gpm, or to whatever rate is required to develop a back-pressure in the oil reservoir equal to about 80 percent of its fracture pressure which is typically about 70% of the overburden load. Injection continues at this rate until the injection pressure levels off at some point safely below fracture pressure. The dissolved gas content of the water injected is raised to saturation at injection pressure, by adjustment of conventional gas pressure regulator 24. Conditions in the injected reservoir at this stage are represented by interface (1) in FIG. 9. Injected gas-saturated water, heated by burning available gas stripped from source water, continues to move away from the injection well. The movement of the flood front is indicated by interfaces numbered (2) and (3) in FIG. 9. As injected water nears the periphery of the oil reservoir, the cross section of flow increases, the fluid pressure declines, and the exsolution of dissolved gas accelerates.

Hot, methane-saturated water spreading beneath the zone of residual oil saturation mobilizes the oil in the reservoir. As the waterflood sweeps radially outward from the injection well, dissolved methane begins to come out of water solution as a consequence of pressure drop in the direction of flow. The methane bubbles formed are of colloidal size; they move rapidly upward in response to the buoyancy gradient, rising at a rate of several hundred feet a day through the reservoir sandstone and any overlying zone of residual oil saturation (MacElvain, 1969). Bubbles entering the zone of dispersed residual oil droplets are caught and dissolved, and oil density and viscosity are decreased. Oil droplets grow larger and become less viscous, buoyancy force increases, and interfacial tension decreases.

Hot water flowing through the zone of dispersed residual oil droplets increases buoyancy force and further decreases oil viscosity, and as oil-phase saturation occurs the oil begins to rise towards the top of the reservoir. As this oil movement begins, water dispersed throughout the smaller pores of the oil reservoir is in part driven ahead of the oil-phase saturation front, and in part bypassed. Displaced water moves first upward, and then radially outward from the injection well, overriding mobilized oil in the lower part of the zone of residual oil. Methane gas not dissolved in oil droplets dissolves in the bypassed pore water. Hot injected water moving past oil filaments tends to drive residual pore water ahead of it. Moving initially upward and outward, residual water eventually escapes downward by virtue of its greater density.

As the vapor-phase gas occupies an increasing part of the pore space in the reservoir sandstone, the relative permeability to water decreases as shown in FIG. 4, back pressure in the injection zone increases, and the flood front migration rate declines. As the back pressure rises, injection rate is reduced so that fracture pressure is not exceeded. Injection is halted when flow rate becomes negligible.

The injection-production well is then shut in by closing valve 10 (valve 9 remaining closed). The source well may continue to flow, the discharge being directed through the gas separator 20 and into disposal well "A" by opening valve 5 and closing valve 4, or to a geopressure geothermal energy development plant by opening valve 15 and closing valve 2. The straddle packer assembly 26 (not shown in FIG. 8) in the injection-production well is raised on its production tubing 28 from its position prior to shutting in the injection-production well illustrated in FIG. 9 and positioned as shown in FIG. 10, in the upper part of the depth interval occupied by the oil reservoir. The packer elements **26*a* and 26*b* are inflated, and the ports 26*c*** between the packer elements are opened to the formation fluid.

Valves 6, 8, 9, 13 and 14 are opened, and reservoir fluids are discharged through the production tubing 28 to the injection-production well separator 30. As discharge continues, the reservoir pressure drops. At this time, a new seismic technique is employed to obtain horizontal and vertical images of the reservoir, in terms of acoustic impedance (Farr, 1979). Such computer-processed reservoir images can be analyzed in terms of reservoir fluid distributions, and changes in those distributions with time, especially if they contain some gas.

It has been shown theoretically that small amounts of free gas produce significant changes in the acoustic impedance of sand beds while having only a small effect on the sand bulk density (Ritch and Smith, 1976). Such low free gas saturations will be created beneath the oil reservoir by the method of this invention wherever appreciable drop in fluid pressure occurs. These low free gas saturations will be evidenced as "false Bright Spot" anomalies on the seismic images. Repeated seismic surveys of the reservoir area, using the same sources (shot points) and receiver locations, provide the data used to fill in image points over the entire area. Modern computer technology enables preservation of acoustic impedance data for the reservoir of interest while discarding all remaining seismic information. This can be done even though the reservoir may tilt or be deformed in response to regional geology (Farr, 1979, p. 101).

It also is possible, using this new method of reservoir imaging, to monitor the movement of injected water saturated with methane during injection by periodically lowering injection pressure and inducing gas bubble formation prior to seismic survey. However, bubble formation drastically reduces the relative permeability to water in the reservoir aquifer, and the use of pressure-reduction techniques must be delayed until volumetric calculations indicate that the injected water has reached a predetermined objective (e.g., the edge of the reservoir).

During the discharging cycle described above, measurements are made of the rates at which gas, oil, and water are produced, and the temperature and pressure of produced fluids are continuously measured and recorded. A hypothetical representation of conditions in the reservoir after several days or weeks of discharge is shown in FIG. 10. A zone of oil-phase saturation, formed during the injection period, moves towards the well; a small gas cap forms at the top of the reservoir by exsolution of methane from the injection water near the well; and a zone of mobilized residual pore water in the oil reservoir is displaced by the rising oil in the peripheral zone of saturation, driven upward and inward by buoyancy and hydrodynamic forces induced by the cone of pressure relief of the producing well.

The flow rate of the well is progressively increased until the fluid produced has a constant gas/oil/water ratio. The flow rate is then reduced in small increments over a period of several days, for study of changes in the gas/oil/water ratio. Through such experimentation, using periodic seismic three-dimension imagery of the reservoir, optimum conditions for oil recovery are determined. If the gas/oil ratio rises appreciably, the flow is stopped, the packer elements 26*a* and 26*b* deflated and the packer assembly 26 reset at greater depth, and flow resumed. Efforts are directed towards producing the most oil with the least possible depletion of reservoir pressure.

Figure 11:
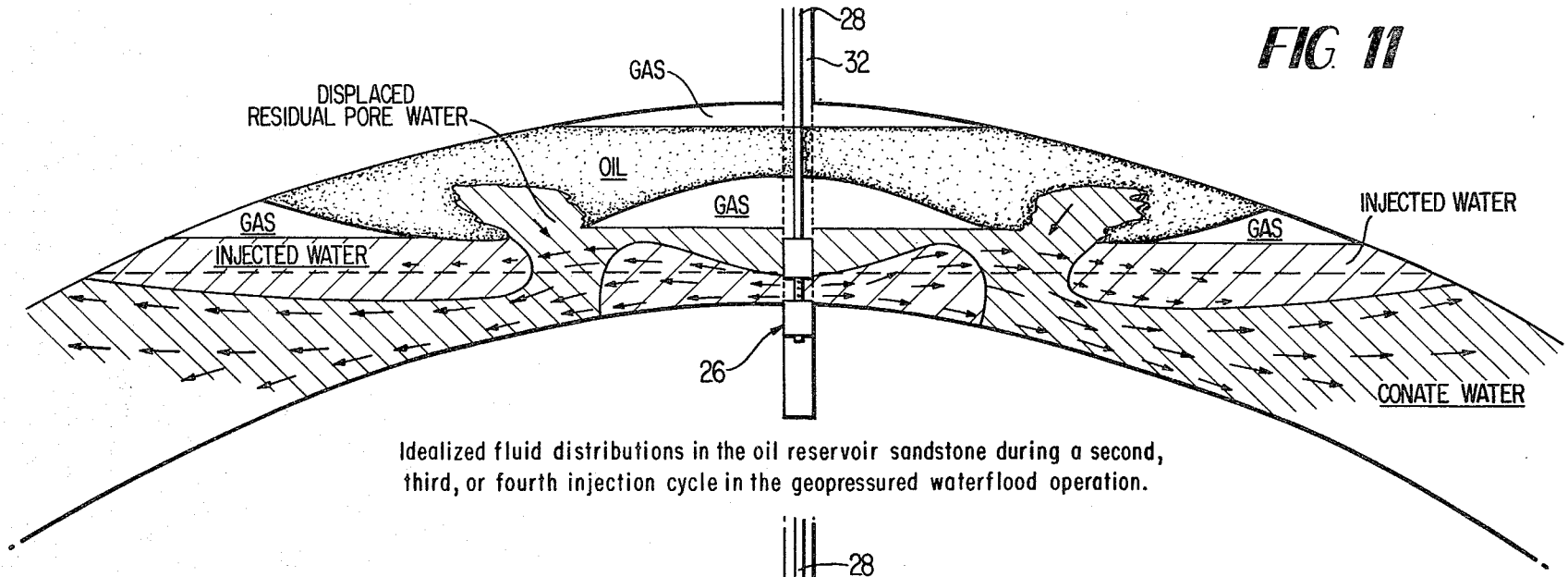
FIG. 11 represents the idealized fluid distributions in the oil reservoir sandstone during a second, third, or fourth injection cycle in the geopressured water flood operation in accordance with the present invention.
Figure 12:
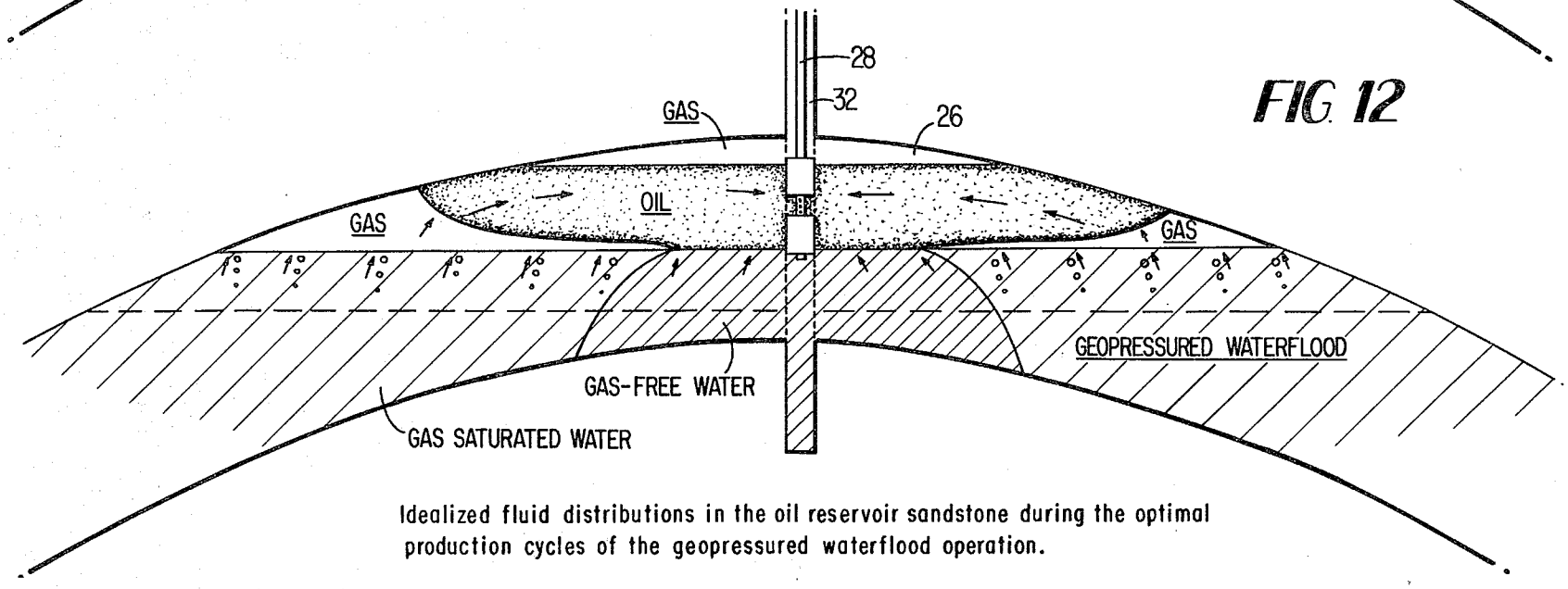
FIG. 12 represents the idealized fluid distributions in the oil reservoir sandstone during the optimal production cycles of the geopressured water flood operation of the present invention.

As the oil production rate becomes uneconomic, production is halted; the packer elements 26*a* and 26*b* are deflated and the packer assembly 26 moved to the bottom of the screen and reset, with the top of the lower packer element 26*b* near the bottom of the screen as illustrated in FIG. 11. The annulus 32 is closed at the well head and hot, methane-saturated water from the geopressured source aquifer is injected into the reservoir aquifer below the level of the original oil-water contact through the ports 26*c* of the packer assembly 26. Injection continues as before until the back-pressure in the reservoir sandstone again approaches fracture pressure. Injection is stopped, the packer assembly 26 raised and set in the zone of continuous oil-phase saturation, and production resumed. Conditions gradually approach those shown in FIG. 12, as the cycle is repeated again and again.

When the oil in the reservoir has been recovered, the reservoir still contains high temperature water and natural gas. The hot water is produced by natural flow, with the packer assembly 26 set deep in the aquifer, below the newly formed gas-water contact. To accomplish this, valves 6, 8, 9, 11, 14 and 16 are opened, and hot water is discharged to geothermal development. Following recovery of the hot water, much of the dissolved natural gas injected with the source water and now in vapor phase is recovered by resetting the packer assembly at the top of the screen with valves 6, 8, 9, 13 and 14 open. The well is produced until it goes to water.

The foregoing discussion of the method and apparatus of this invention describes an installation utilizing one injection-production well. It is likely that most field applications of the invention will involve two or more such wells, and the oil-recovery procedures, in terms of injection-production cycles, will be somewhat different. Where oil reservoirs are at relatively shallow depth, one or more production wells can be used, screened through the full thickness of the reservoir sandstone and fitted with movable straddle assembly packers on production tubing. Oil and gas recovery rates would thus be accelerated, drainage of the reservoir improved, and the overall efficiency of the enhanced recovery increased.

The present invention is well adapted to achieve the objectives and attain the results and advantages described, as well as others inherent therein. While the presently preferred embodiments of the invention are provided for the purpose of disclosure, numerous modifications and changes will readily suggest themselves to those skilled in the art without departing from the scope of the present invention. Accordingly, the present disclosure is considered illustrative, with the scope of the invention being defined by the appended claims.

What is claimed is:

1. A method for the enhanced recovery of petroleum from wells bored into an oil reservoir comprising:

(A) drilling a well so that it penetrates an oil reservoir;

(B) injecting water having a dissolved natural gas content at or near saturation at a temperature above 300° F. into the oil reservoir through the well bore at a flow rate sufficient to develop a back-pressure in the oil reservoir equal to between about 80% of its fracture pressure and a pressure below its fracture pressure; and (C) producing oil through the well bore after the flow rate of injected water necessary to maintain the back-pressure below the oil reservoir fracture pressure drops below a predetermined level.

2. The method of claim 1 in which the water injected into the oil reservoir is derived from a geopressured aquifer.

3. The method of claim 1 in which the water injected into the oil reservoir initially has a dissolved natural gas content below saturation and the dissolved natural gas content of the injected water is raised to saturation while lowering the flow rate of the injected water as necessary to maintain the back-pressure below the oil reservoir fracture pressure.

4. The method of claim 1 in which the water is injected into the oil reservoir through a screen completing a portion of the well bore penetrating into the oil reservoir and produced using sand screening means.

5. The method of claim 1 in which a portion of the water is injected into the oil reservoir through a straddle packer assembly means including spaced apart inflatable packer elements and fluid ports.

6. The method of claim 1 in which the water is derived from a geopressured aquifer and at least a portion of the water is disposed of in a hydropressured aquifer.

7. The method of claim 1 in which the water is derived from a geopressured aquifer and at least a portion of the water is used for geopressure-geothermal development.

8. A method for the enhanced recovery of petroleum from wells bored into an oil reservoir comprising;

(A) drilling a source well into a geopressured source aquifer containing water having a temperature above 300° F. and having large quantities of natural gas dissolved or dispersed therein at saturation or near saturation levels, said source aquifer having a closed-in well-head pressure which exceeds the fracture pressure of an oil reservoir to be flooded;

(B) drilling an injection-production well into an oil reservoir;

(C) injecting water from the source well into the injection-production well through the well bore of the injection-production well at a flow rate sufficient to develop a back-pressure in the oil reservoir equal to between about 80% of its fracture pressure and a pressure below its fracture pressure; and (D) producing oil from the oil reservoir through the well bore of the injection-production well when the flow rate of water necessary to maintain the back-pressure below the oil reservoir fracture pressure drops below a predetermined level.

9. The method of claim 8 in which the water injected into the injection-production well is initially treated to deplete the dissolved natural gas content below saturation and the dissolved natural gas content is subsequently raised to saturation while lowering the flow rate of the injected water as necessary to maintain the back-pressure below the oil reservoir fracture pressure.

10. The method of claim 9 in which the pressure of the water is reduced to exsolve natural gas and the exsolved natural gas is separated from the water in a gas separator.

11. The method of claim 10 in which at least a portion of the natural gas separated from the water is used to heat the water injected into the injection-production well.

12. The method of claim 11 in which the natural gas separated from the water is used to heat the water injected into the injection-production well to a temperature of about 400° to 500° F.

13. The method of claim 8 in which the portion of the source well bore penetrating into the source aquifer is screened using sand screening means.

14. The method of claim 13 in which the portion of the injection-production well bore penetrating into the oil reservoir is screened using sand screening means.

15. A method for the enhanced recovery of petroleum from wells bored into an oil reservoir comprising;

(A) drilling a well so that it penetrates an oil reservoir;

(B) using sand screening means to complete a portion of the well bore penetrating into the oil reservoir;

(C) positioning a straddle packer assembly means including spaced apart inflatable packer elements and fluid ports in the well bore below the screened portion of the well bore, the straddle packer assembly means being associated with production tubing such that an annulus is defined between the outer surface of the production tubing and the inner surface of the well bore;

(D) injecting water having a natural gas content at or near saturation at a temperature above 300° F. into the oil reservoir through the annulus and screened portion of the well bore at a flow rate sufficient to develop a back-pressure in the oil reservoir equal to between about 80% of its fracture pressure and a pressure below its fracture pressure; and (E) raising the straddle packer assembly into an upper screened portion of the well bore, inflating the packer elements and producing oil through the production tubing.

16. The method of claim 15 in which the straddle packer assembly is lowered into a lower screened portion of the well bore after oil production is discontinued, the packer elements are inflated and water is injected into the oil reservoir through the production tubing.

17. The method of claim 16 in which the straddle packer assembly is raised into an upper screened portion of the well bore after water is injected into the oil reservoir, the packer elements are inflated, and oil is produced through the production tubing.

18. A method for the enhanced recovery of petroleum from wells bored into an oil reservoir comprising;

(A) drilling a well so that it penetrates an oil reservoir;

(B) using sand screening means to complete the portion of the well bore penetrating into the oil reservoir;

(C) positioning a straddle packer assembly means including spaced-apart inflatable packer elements and fluid ports below the screened portion of the well bore;

(D) injecting water having a dissolved natural gas content at or near saturation at a temperature above 300° F. into the oil reservoir through the screened portion of the well bore; and (E) raising the straddle packer assembly into the screened portion of the well bore and producing oil through the straddle packer assembly.

19. The method of claim 18 in which the straddle packer assembly is lowered into a lower screened portion of the well bore and water is injected into the oil reservoir through the straddle packer assembly.

20. The method of claim 19 in which the straddle packer assembly is raised into an upper screened portion of the well bore and oil is produced through the straddle packer assembly.

21. A method for the enhanced recovery of petroleum from wells bored into an oil reservoir comprising:

(A) drilling a well so that it penetrates an oil reservoir;

(B) using sand screening means to complete a portion of the well bore penetrating into the oil reservoir;

(C) positioning a straddle packer assembly means including spaced-apart inflatable packer elements and fluid ports in the well bore, the straddle packer assembly means being associated with production tubing such that an annulus is defined between the outer surface of the production tubing and the inner surface of the well bore;

(D) injecting water from a geopressured aquifer having a depleted dissolved natural gas content below saturation at a temperature above 300° F. into the oil reservoir through the annulus and screened portion of the well bore at a flow rate sufficient to develop a back-pressure in the oil reservoir equal to between about 80% of its fracture pressure and a pressure below its fracture pressure;

(E) raising the dissolved natural gas content of the injected water to saturation while lowering the flow rate of the injected water as necessary to maintain the back-pressure below the oil reservoir fracture pressure;

(F) discontinuing the injection of water when the flow rate necessary to maintain the back-pressure below the oil reservoir fracture pressure drops below a predetermined level;

(G) raising the straddle packer assembly into an upper screened portion of the well bore, inflating the packer elements and producing oil through the production tubing;

(H) discontinuing the production of oil when the oil production rate drops below a predetermined level;

(I) lowering the straddle packer assembly into a lower screened portion of the well bore, inflating the packer elements and injecting water into the oil reservoir through the production tubing; and (J) raising the straddle packer assembly into an upper screened portion of the well bore, inflating the packer elements and producing oil through the production tubing.

22. A system for the enhanced recovery of petroleum from wells bored into an oil reservoir comprising;

(A) a source well drilled into a geopressured source aquifer containing water having a temperature above 300° F. and having large quantities of natural gas dissolved or dispersed therein at saturation or near saturation levels, said source aquifer having a closed-in well-head pressure which exceeds the fracture pressure of an oil reservoir to be flooded;

(B) an injection-production well drilled into an oil reservoir;

(C) means for injecting water from the source well into the injection-production well through the well bore of the injection-production well at a flow rate sufficient to develop a back-pressure in the oil reservoir equal to between about 80% of its fracture pressure and a pressure below its fracture pressure; and (D) means for producing oil from the oil reservoir through the well bore of the injection-production well when the flow rate of water necessary to maintain the back-pressure below the oil reservoir fracture pressure drops below a predetermined level.

23. The system of claim 22 including means for initially treating the water injected into the injection-production well bore to deplete the dissolved natural gas content below saturation and means for subsequently raising to saturation the dissolved natural gas content while lowering the flow rate of the injected water as necessary to maintain the back-pressure below the oil reservoir fracture pressure.

24. The system of claim 23 in which the means for initially treating the water is a pressure separator which reduces the pressure of the water to exsolve natural gas and separates the exsolved natural gas from the water.

25. The system of claim 24 including means for using at least a portion of the natural gas separated from the water to heat the water injected into the injection-production well.

26. The system of claim 25 including means for using the natural gas separated from the water to heat the water injected into the injection-production well to a temperature of about 400° to 500° F.

27. The system of claim 22 including a screen for the portion of the source well bore penetrating into the source aquifier, said screen being formed using sand screening means.

28. The system of claim 27 including a screen for the portion of the injection-production well bore penetrating into the oil reservoir, said screen being formed using sand screening means.

* * * * *